US007540689B1

(12) United States Patent
Major, Sr.

(10) Patent No.: US 7,540,689 B1
(45) Date of Patent: Jun. 2, 2009

(54) COUNTERWEIGHT SYSTEM

(76) Inventor: William J. Major, Sr., 86 MIddleboro Rd., East Freetown, MA (US) 02717

( * ) Notice: Subject to any disclaimer, the term of this patent is extended or adjusted under 35 U.S.C. 154(b) by 47 days.

(21) Appl. No.: 11/653,138

(22) Filed: Jan. 16, 2007

(51) Int. Cl.
*E01C 19/26* (2006.01)

(52) U.S. Cl. ..... 404/130; 404/122; 404/128; 172/611; 172/668

(58) Field of Classification Search ..... 404/128, 404/122; 172/611, 525, 677, 439, 518
See application file for complete search history.

(56) References Cited

U.S. PATENT DOCUMENTS 2,562,318 A * 7/1951 Lewis ..... 403/385
3,304,631 A * 2/1967 Welser ..... 37/414
3,730,545 A 5/1973 Allori
3,758,132 A 9/1973 Elfes et al.
3,889,978 A * 6/1975 Kann ..... 280/417.1
4,098,344 A 7/1978 Johnson
4,378,052 A * 3/1983 Anderson ..... 172/449
4,502,709 A 3/1985 Schaeff
4,560,191 A * 12/1985 Grassi ..... 292/264
4,878,544 A 11/1989 Barnhart
5,088,855 A * 2/1992 Giliberti ..... 404/103
5,104,257 A * 4/1992 Lebrero Martinez et al. ..... 404/117
5,114,269 A * 5/1992 Shepherd ..... 404/122
5,156,215 A * 10/1992 Jensen ..... 172/611
5,316,191 A * 5/1994 Gibson et al. ..... 224/401
5,476,279 A * 12/1995 Klemetsen ..... 280/415.1
5,709,274 A * 1/1998 Herbold ..... 172/248
5,733,408 A * 3/1998 Zeidler ..... 156/379.9
5,762,147 A * 6/1998 Baird ..... 172/831
D399,215 S 10/1998 Bruns
5,853,187 A * 12/1998 Maier ..... 280/495
5,915,714 A * 6/1999 Bell et al. ..... 280/456.1
5,984,019 A * 11/1999 Hund ..... 172/439
6,109,640 A * 8/2000 Allen et al. ..... 280/417.1
6,116,633 A * 9/2000 Pride ..... 280/511
6,161,429 A * 12/2000 Marvel et al. ..... 73/146
6,168,348 B1 * 1/2001 Meyer et al. ..... 404/90
6,354,761 B1 * 3/2002 Clements ..... 404/129
6,595,397 B2 * 7/2003 Teich ..... 224/410
6,612,380 B2 * 9/2003 Pyle ..... 172/439
6,682,086 B1 * 1/2004 Erickson ..... 280/166
6,988,560 B2 * 1/2006 Bay ..... 172/272
7,100,704 B2 * 9/2006 Potter ..... 172/439
7,104,726 B2 * 9/2006 Wallace ..... 404/128
7,125,033 B2 * 10/2006 Forrister ..... 280/416.2
7,249,771 B1 * 7/2007 Brennan et al. ..... 280/35
2002/0100175 A1 * 8/2002 King ..... 33/264
2003/0019643 A1 * 1/2003 Pyle ..... 172/439
2003/0209898 A1 * 11/2003 Parker et al. ..... 280/789
2004/0118887 A1 * 6/2004 Axelson ..... 224/404
2006/0027997 A1 * 2/2006 Grace ..... 280/417.1
2006/0087101 A1 * 4/2006 Yon ..... 280/504
2006/0237202 A1 * 10/2006 Byles et al. ..... 172/518
2008/0054598 A1 * 3/2008 Weber et al. ..... 280/414.1

* cited by examiner

*Primary Examiner*—Raymond W Addie

(57) ABSTRACT

A counterweight system for maintain stability of a tractor and the ability to compress a support surface when desired includes a tractor. A frame is selectively hitched to the tractor. A counterweight is coupled to the frame. The counterweight has a weight to balance weight positioned at the front of the tractor. A plurality of hitch balls is coupled to the frame. A trailer receives one of the hitch balls to allow the trailer to be coupled to the frame and to be towed to a different location.

1 Claim, 7 Drawing Sheets

COUNTERWEIGHT SYSTEM

BACKGROUND OF THE INVENTION

1. Field of the Invention

The present invention relates to tractor attachments and more particularly pertains to a new tractor attachment for maintain stability of a tractor and the ability to compress a support surface when desired.

2. Description of the Prior Art

The use of tractor attachments is known in the prior art. While these devices fulfill their respective, particular objectives and requirements, the need remains for a system that has certain improved features that allow a trailer to be mounted to the system and be towed to a new location. Additionally, the system should also include a plurality of risers that can be positioned around a tool box to keep positioned on the system.

SUMMARY OF THE INVENTION

The present invention meets the needs presented above by generally comprising a tractor. A frame is selectively hitched to the tractor. A counterweight is coupled to the frame. The counterweight has a weight to balance weight positioned at the front of the tractor. A plurality of hitch balls is coupled to the frame. A trailer receives one of the hitch balls to allow the trailer to be coupled to the frame and to be towed to a different location.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
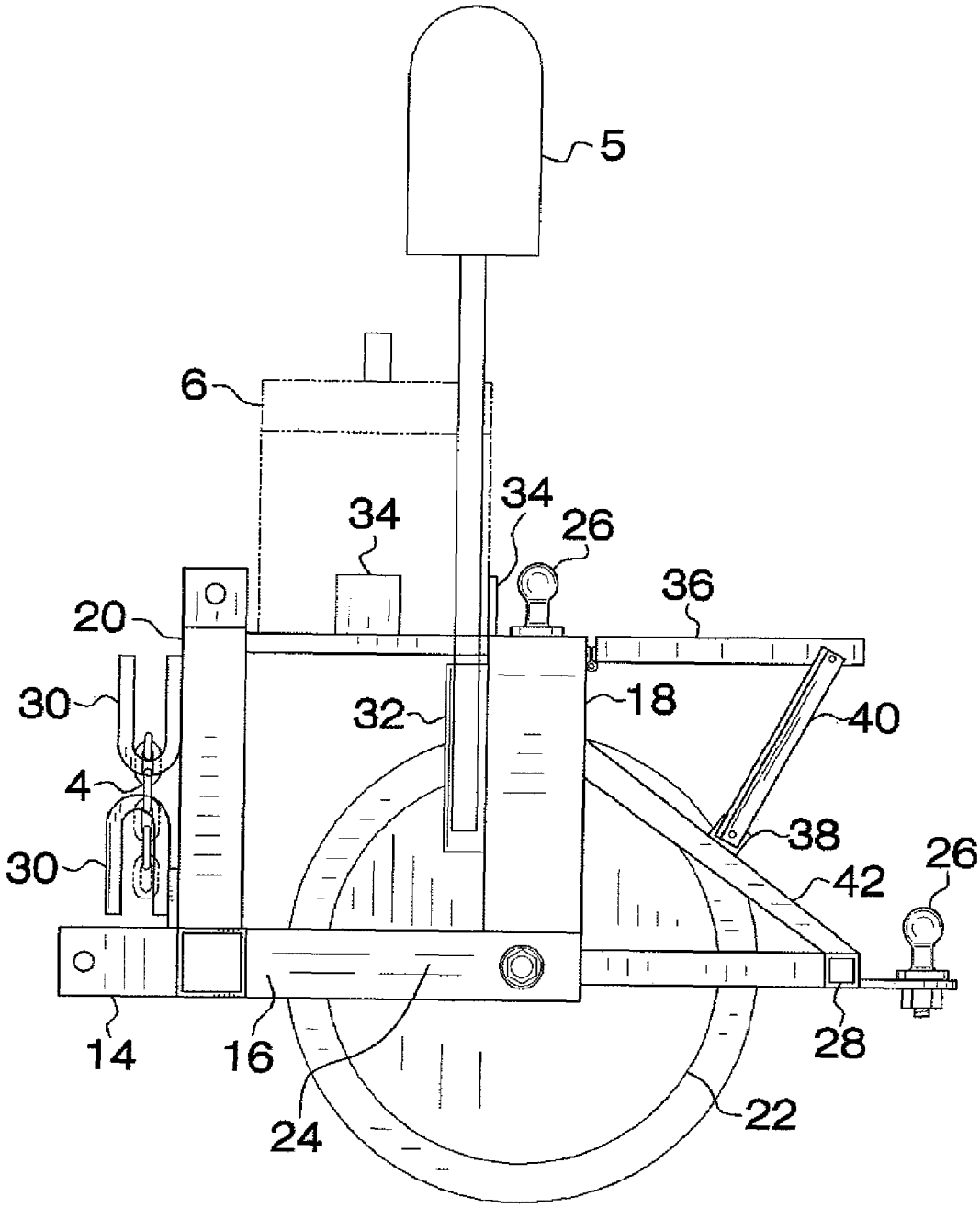
FIG. 1 is a side view of a frame and counterweight of a counterweight system according to the present invention.
Figure 2:
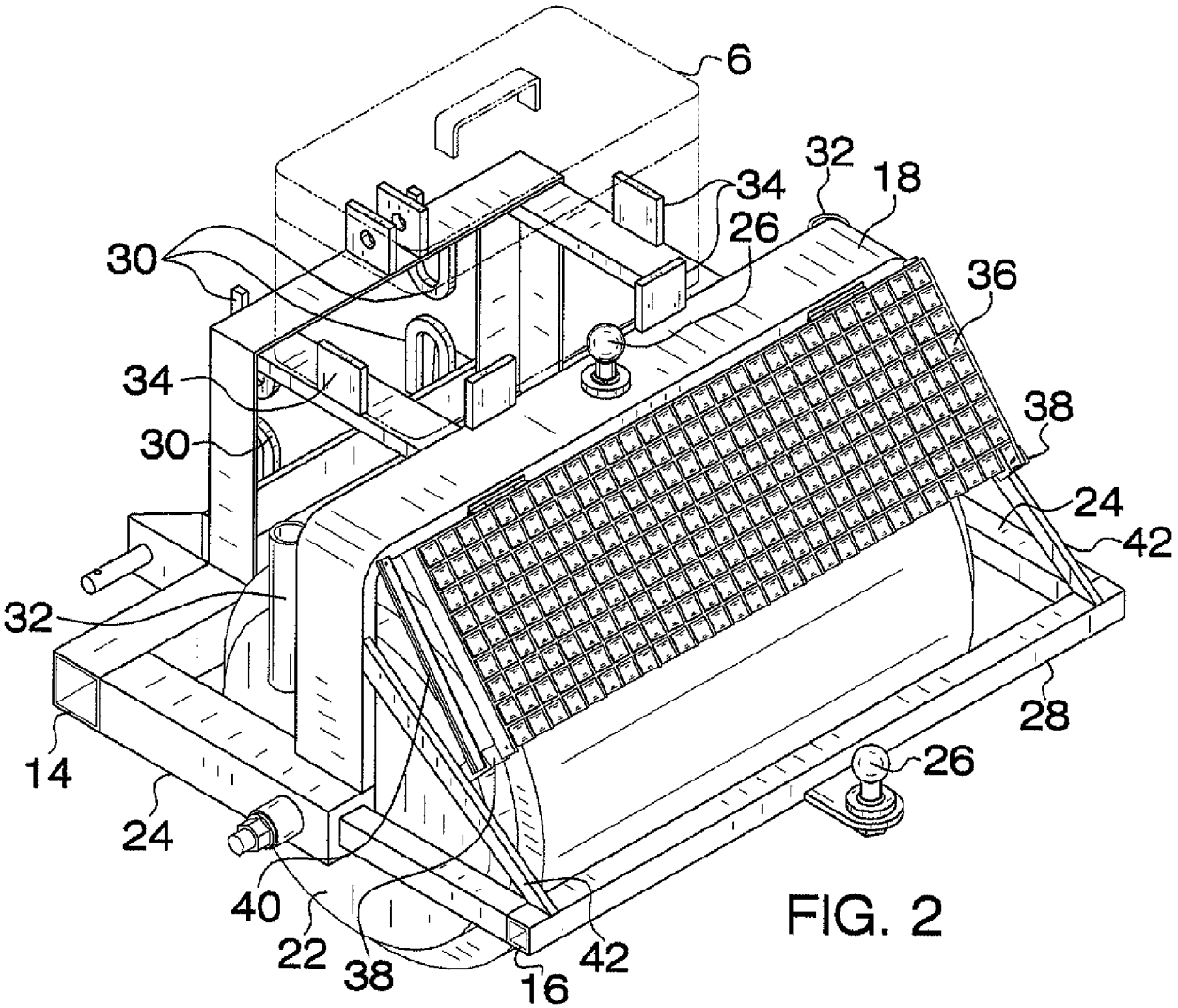
FIG. 2 is a rear perspective view of the present invention.
Figure 3:
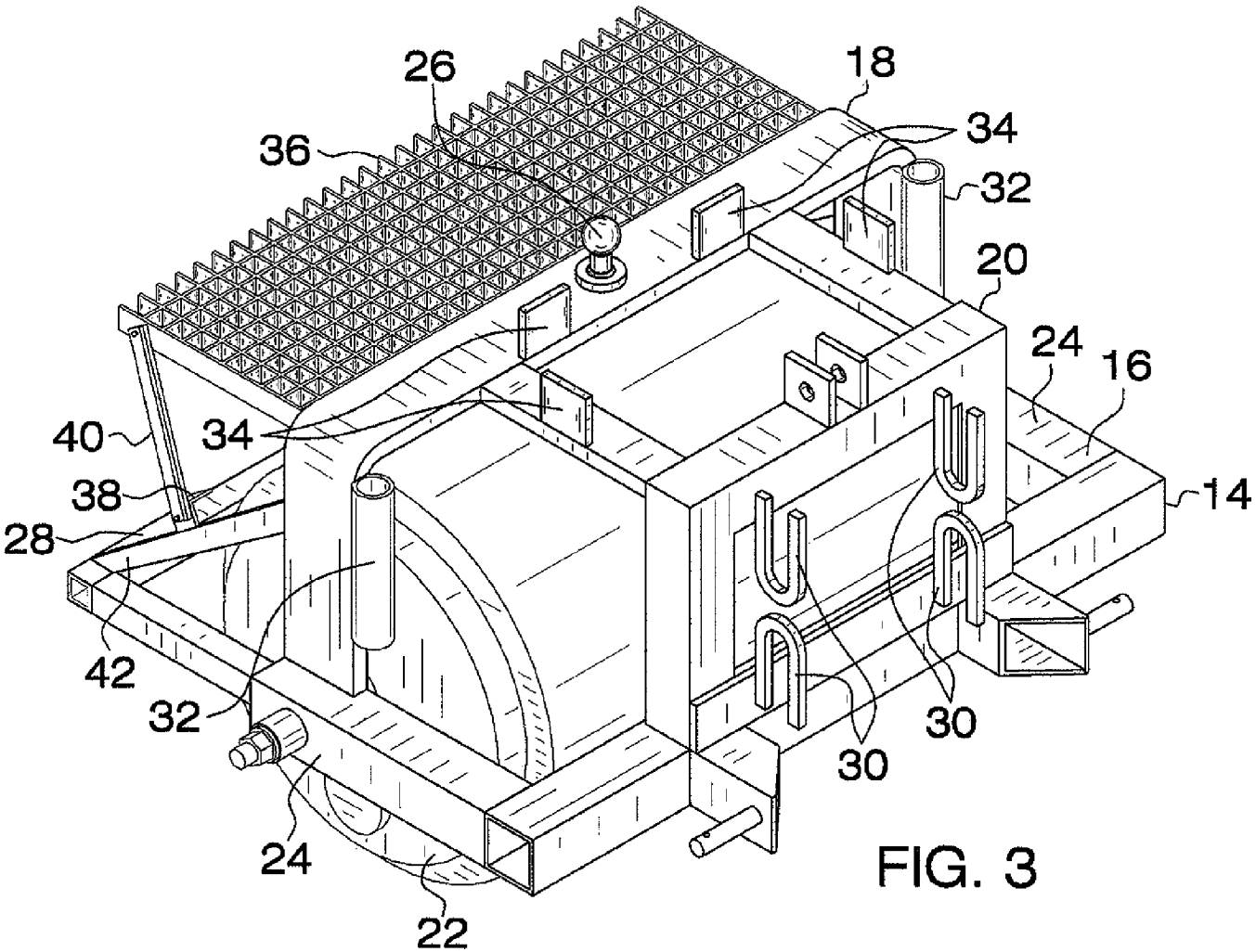
FIG. 3 is a front perspective view of the present invention.
Figure 4:
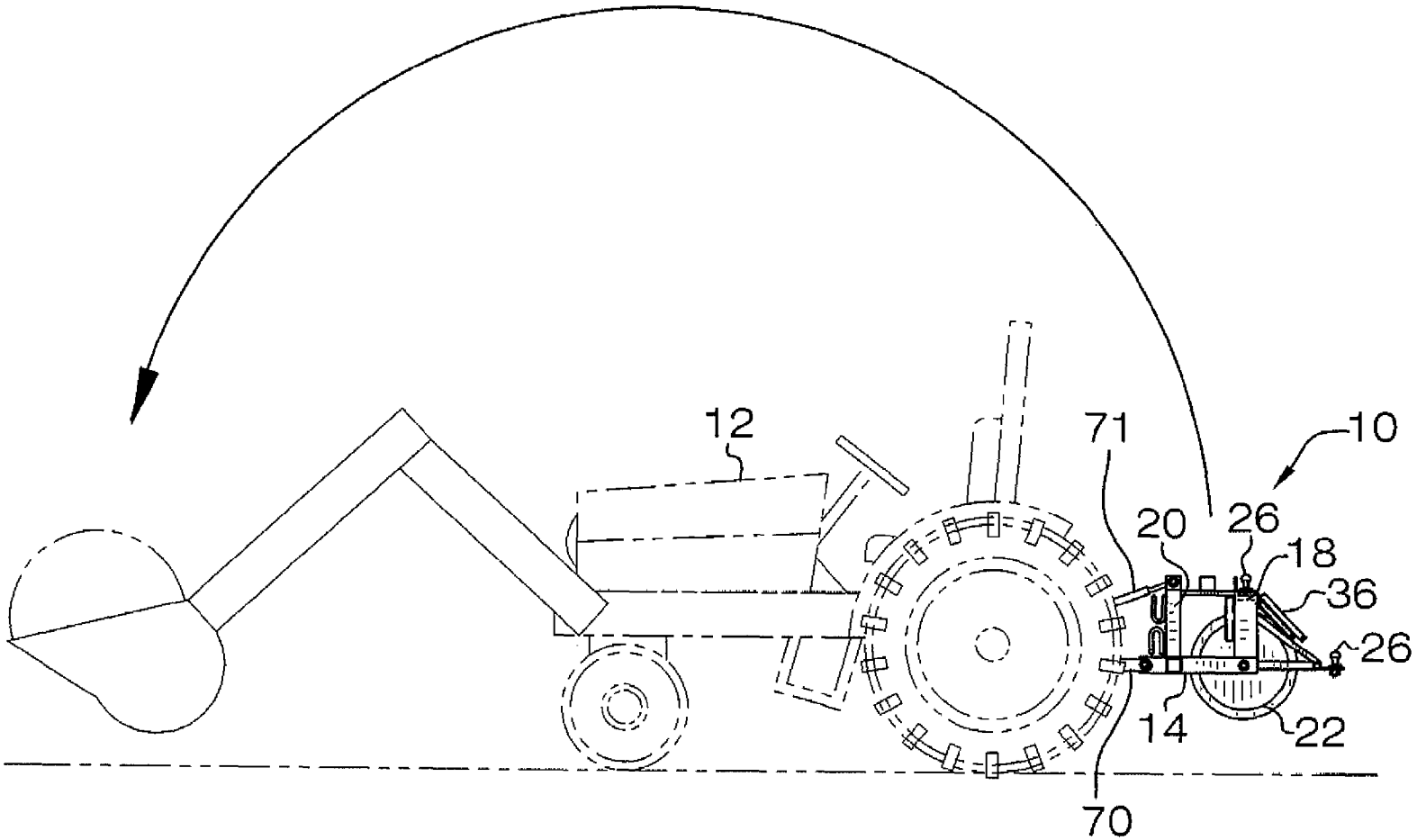
FIG. 4 is a side view of the present invention shown in use.
Figure 5:
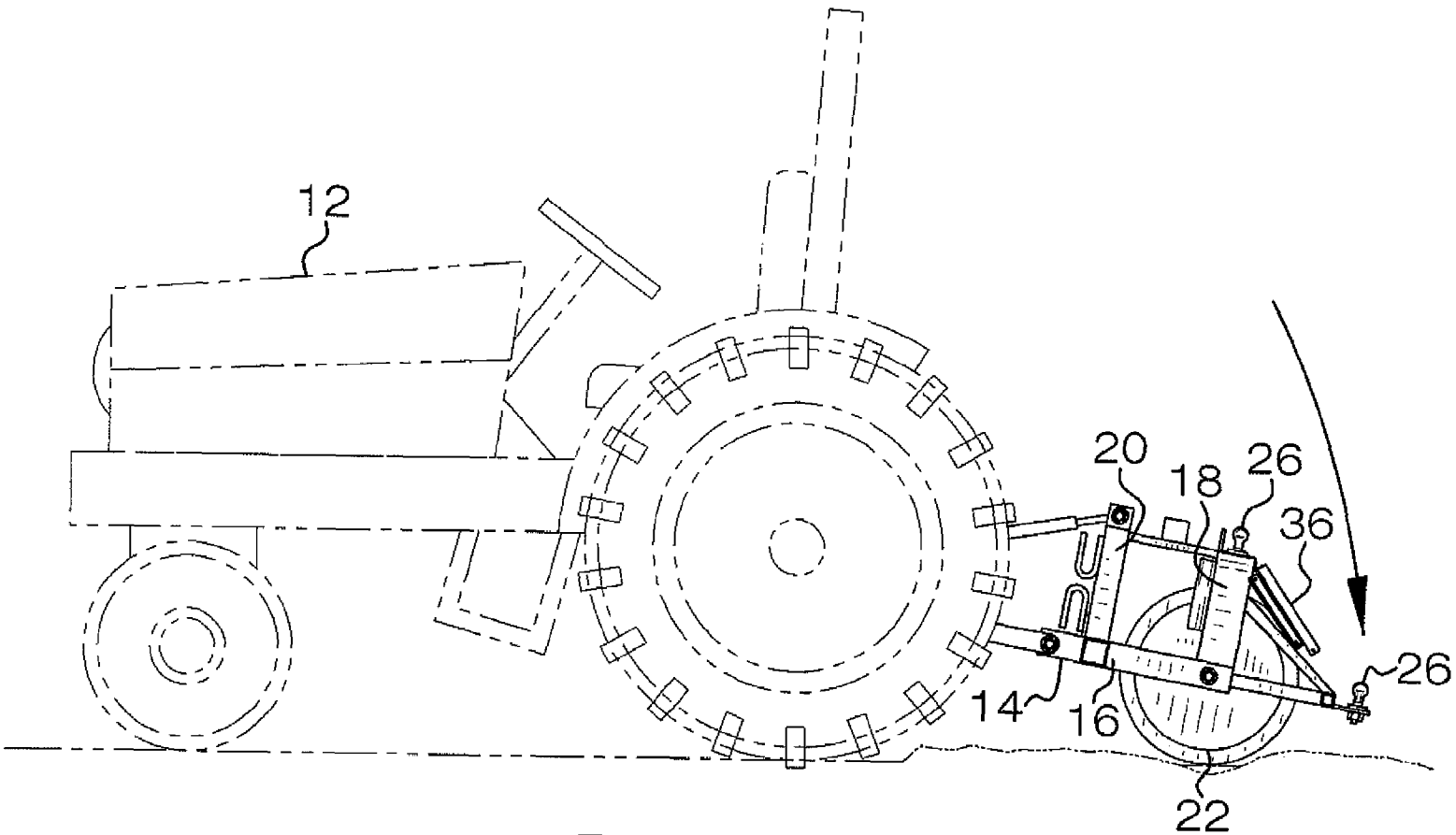
FIG. 5 is a side view of the present invention shown compressing the support surface.
Figure 6:
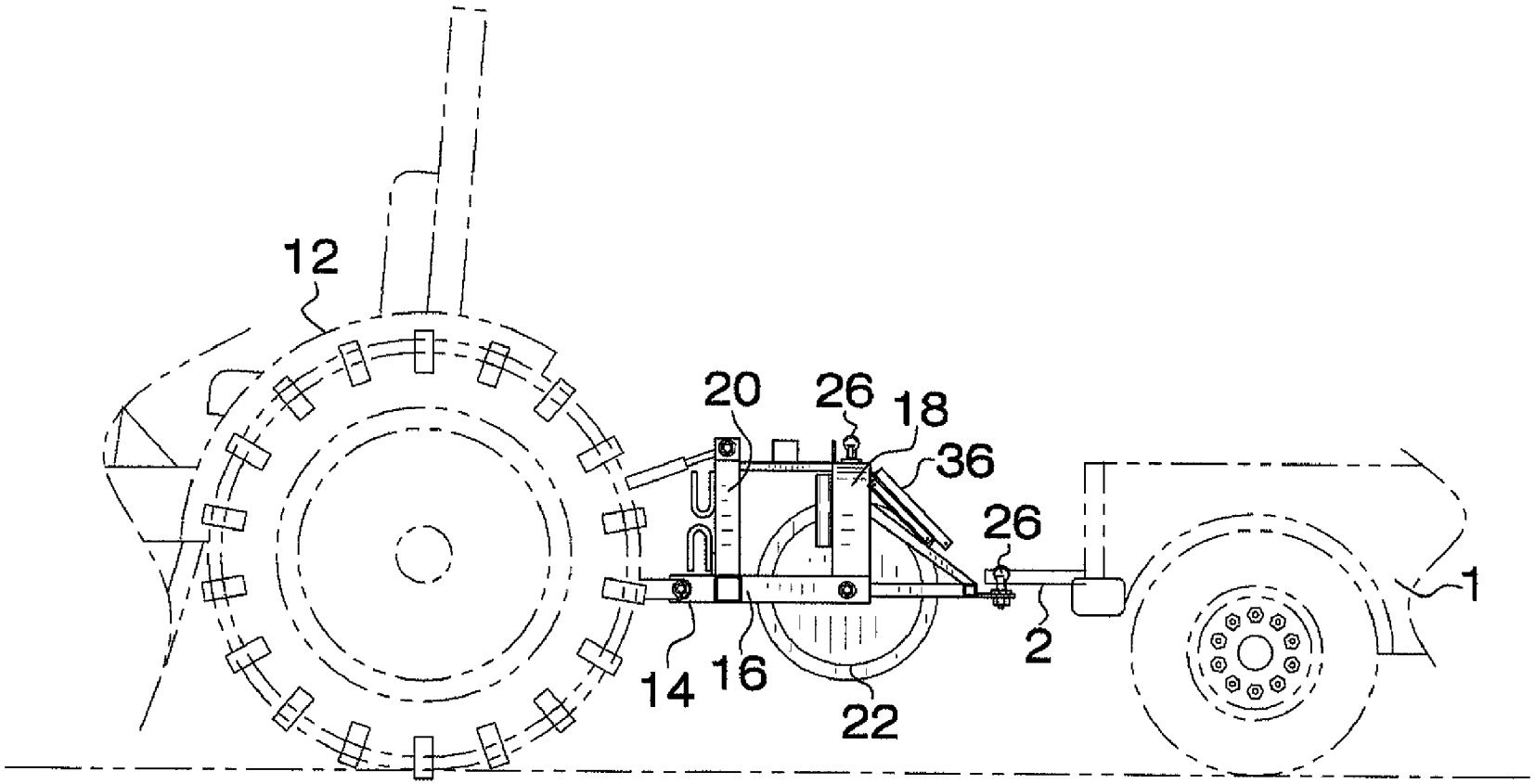
FIG. 6 is a side view of the present invention towing a trailer.
Figure 7:
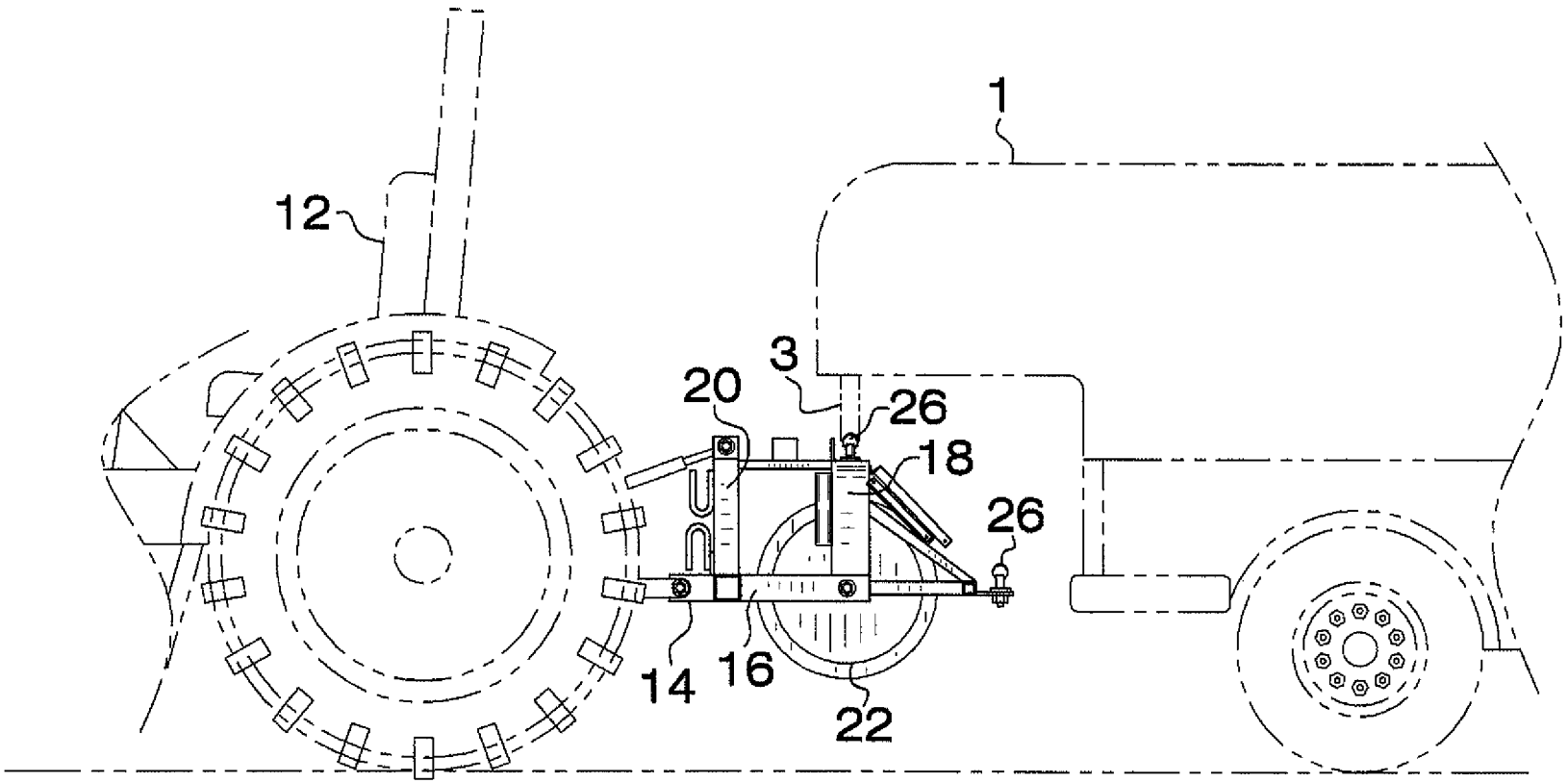
FIG. 7 is a side view of the present invention towing a fifth wheel trailer.

With reference now to the drawings, and in particular to FIGS. 1 through 7 thereof, a new tractor attachment embodying the principles and concepts of the present invention and generally designated by the reference numeral 10 will be described.

As best illustrated in FIGS. 1 through 7, the counterweight system 10 generally comprises a tractor 12. A frame 14 is selectively hitched to the tractor 12. The frame 14 includes a horizontal loop 16 being approximately rectangular shaped. The horizontal loop 16 is mounted to a pair of lower mounts 70 of a three point hitch of the tractor 12. A vertical stanchion 18 is coupled to the horizontal loop 16. The vertical stanchion 18 extends upwardly from and across a length of the horizontal loop 16. An extension bracket 20 is coupled to the vertical stanchion 18 and the horizontal loop 16. The extension bracket 20 and the horizontal loop 16 are hitched to the tractor 12 to couple the frame 14 to the tractor 12. The extension bracket 20 is mounted to an upper mount 71 of the three point hitch of the tractor 12.

A counterweight 22 is coupled to the frame 14. The counterweight 22 has a weight to balance weight positioned at the front of the tractor 12. The counterweight 22 is approximately cylindrical shaped. The counterweight 22 is rotatably coupled to a pair of side bars 24 of the horizontal loop 16 to allow the counterweight 22 to roll across a support surface to compress the support surface with the weight of the counterweight 22.

A plurality of hitch balls 26 is coupled to the frame 14. A trailer 1 receives one of the hitch balls 26 to allow the trailer 1 to be coupled to the frame 14 and to be towed to a different location. One of the hitch balls 26 is coupled to a rear bar 28 of the horizontal loop 16 to be inserted into a tongue 2 of the trailer 1. One of the hitch balls 26 is coupled to the vertical stanchion 18 and upwardly extends therefrom to receive a gooseneck 3 of a fifth wheel trailer 1.

A plurality of hanger brackets 30 is coupled to the frame 14. Each of the hanger brackets 30 receives a chain 4 wrapped around the hanger brackets 30 to store the chain 4 on the frame 14. Each of the hanger brackets 30 is approximately U-shaped. A pair of the hanger brackets 30 opens upwardly and a pair of the hanger brackets 30 opening downwardly to allow the chain 4 to be wrapped around the hanger brackets 30.

A plurality of sleeves 32 is coupled to the frame 14. Each of the sleeves 32 receives a handle of a tool 5 to store the tool 5 on the frame 14. The sleeves 32 are coupled to the vertical stanchion 18. Each of the sleeves 32 is orientated approximately vertically.

A plurality of risers 34 is coupled to the frame 14 and upwardly extending therefrom. The risers 34 are arranged in an approximately rectangular formation to permit a toolbox 6 to be positioned between the risers 34 and inhibit the toolbox 6 sliding off of the frame 14. A portion of the risers 34 is coupled to the extension bracket 20 and a portion of the brackets is coupled to the vertical stanchion 18 adjacent the extension bracket 20.

A table 36 is hingedly coupled to the frame 14. The table 36 is pivotal between a horizontal position to receive articles to be positioned on the table 36 and an angled position to store the table 36 when not in use. The table 36 is hingedly coupled to the vertical stanchion 18 of the frame 14. Each of a pair of gussets 38 is coupled to the frame 14 and has one of a pair of support arms 40 pivotally coupled thereto. Each of a pair of braces 42 extending between the vertical stanchion 18 and the rear bar 28 has one of the gussets 38 coupled thereto. Each of the support arms 40 is extended between the associated one of the gussets 38 and the table 36 to maintain the table 36 in the horizontal position. The support arms 40 are removed from the table 36 and the table 36 abuts the gussets 38 when the table 36 is positioned in the angle position. The gussets 38 inhibit the table 36 abutting the counterweight 22 when the table 36 is in the angled position.

In use, the frame 14 is mounted to the three point hitch of the tractor 12. The counterweight 22 counters the weight being applied to the front of the tractor 12 and maintains stability of the tractor 12. The counterweight 22 may also being positioned against the support surface to compact the support surface when the counterweight 22 is rolled across the support surface. The hitch balls 26 are used to secure the trailer 1 to the frame 14 and allow the trailer 1 to be towed to a different location.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A counterweight system comprising:

a tractor;

a frame being selectively hitched to said tractor, said frame comprising:

a horizontal loop being approximately rectangular shaped, said horizontal loop being mounted to a pair of lower mounts of a three point hitch of said tractor;

a vertical stanchion being coupled to said horizontal loop, said vertical stanchion extending upwardly from and across a length of said horizontal loop;

an extension bracket being coupled to said vertical stanchion and said horizontal loop, said extension bracket and said horizontal loop being hitched to said tractor to couple said frame to said tractor, said extension bracket being mounted to an upper mount of the three point hitch of said tractor;

a counterweight being coupled to said frame, said counterweight having a weight to balance weight positioned at the front of said tractor, said counterweight being approximately cylindrical shaped, said counterweight being rotatably coupled to a pair of side bars of said horizontal loop to allow said counterweight to roll across a support surface to compress the support surface with the weight of said counterweight;

a plurality of hitch balls, each of said hitch balls being coupled to said frame, a trailer receiving one of said hitch balls to allow the trailer to be coupled to said frame and to be towed to a different location, one of said hitch balls being coupled to a rear bar of said horizontal loop to be inserted into a tongue of the trailer, one of said hitch balls being coupled to said vertical stanchion and upwardly extending therefrom to receive a gooseneck of a fifth wheel trailer;

a plurality of hanger brackets being coupled to said frame, each of said hanger brackets receiving a chain wrapped around said hanger brackets to store the chain on said frame, each of said hanger brackets being approximately U-shaped, a pair of said hanger brackets opening upwardly and a pair of said hanger brackets opening downwardly to allow the chain to be wrapped around said hanger brackets;

a plurality of sleeves, each of said sleeves being coupled to said frame, each of said sleeves receiving a handle of a tool to store the tool on said frame, each of said sleeves being coupled to said vertical stanchion, each of said sleeves being orientated approximately vertically;

a plurality of risers, each of said risers being coupled to said frame and upwardly extending therefrom, said risers being arranged in an approximately rectangular formation to permit a toolbox to be positioned between said risers and inhibit the toolbox sliding off of said frame, a portion of said risers being coupled to said extension bracket and a portion of said brackets being coupled to said vertical stanchion adjacent said extension bracket;

a table being hingedly coupled to said frame, said table being pivotal between a horizontal position to receive articles to be positioned on said table and an angled position to store said table when not in use, said table being hingedly coupled to said vertical stanchion of said frame; and a pair of support arms, each of a pair of gussets being coupled to said frame having one of said support arms pivotally coupled thereto, each of a pair of braces extending between said vertical stanchion and said rear bar having one of said gussets coupled thereto, each of said support arms being extended between the associated one of said gussets and said table to maintain said table in the horizontal position, said support arms being removed from said table and said table abutting said gussets when said table is positioned in said angle position, said gussets inhibiting said table abutting said counterweight when said table is in said angled position.

* * * * *